United States Patent [19]

Hens

[11] Patent Number: 4,933,595

[45] Date of Patent: Jun. 12, 1990

[54] COLOR DISPLAY TUBE INCLUDING A COLOR SELECTION ELECTRODE WITH BORDER

[75] Inventor: Theodoor C. A. Hens, Eindhoven, Netherlands

[73] Assignee: U.S. Philips Corporation, New York, N.Y.

[21] Appl. No.: 254,511

[22] Filed: Oct. 6, 1988

[30] Foreign Application Priority Data

Oct. 9, 1987 [NL] Netherlands ..... 8702399

[51] Int. Cl.[5] ..... H01J 29/07

[52] U.S. Cl. ..... 313/402; 313/407

[58] Field of Search ..... 313/407, 402, 408

[56] References Cited

U.S. PATENT DOCUMENTS 4,191,909 3/1980 Dougherty ..... 313/402

4,551,651 11/1985 van der Ven ..... 313/402

*Primary Examiner*—Kenneth Wieder

*Attorney, Agent, or Firm*—John C. Fox

[57] ABSTRACT

A color electron beam display tube comprises a color selection electrode having a large plurality of apertures on a border, the border, having an interior portion which extends towards the display window and an exterior portion extending away from the display window, characterized in that substantially every point of the border is an element of an electron beam path.

8 Claims, 6 Drawing Sheets

COLOR DISPLAY TUBE INCLUDING A COLOR SELECTION ELECTRODE WITH BORDER

BACKGROUND OF THE INVENTION

The invention relates to a color display tube comprising an envelope having a display window, an electron gun for generating electron beams, a deflection system for deflecting the electron beams along electron beam paths, a color selection-electron having a large plurality of apertures, the color selection electrode having an border including an interior portion which extends towards the display window and an exterior portion extending away from the display window, and suspension means for suspending the color selection-electrode in the envelope.

U.S. Pat. No. 4,551,651 describes such a color display tube comprising an envelope including a substantially rectangular display window having an upright peripheral edge, and a substantially rectangular color selection-electrode suspended in the corners of the upright edge behind the display window, with the aid of suspension means which each include a flat spring element connected to the color selection-electrode and perpendicular to the deflected electron beam path in the relevant corner. The color selection-electrode has a border comprising a ridge extending towards the display window and a collar extending away from the display window, the centre of a cross-section through the ridge and collar being located substantially in the plane of the shadow mask.

A phenomenon occuring in a color display tube of the type defined in the opening paragraph, important for the picture quality, is what is commonly referred to as the "overall doming" of the color selection electrode. During usage, in response to impingement of the color selection electrode by electrons, the curvature of the color selection electrode changes. This results in displacement of the landing spot of the electron beam on the picture screen, a so-called landing displacement. The significance of landing displacements will be described in further detail in connection with the drawings.

In an embodiment of the prior art display tube, the collar is at such an angle to the longitudinal axis of the picture tube that electrons directly reflected by the collar fall on the color selection electrode outside the pattern of apertures in the color selection electrode, whereby the overall surface area of the color selection electrode is impinged by electron, which reduces distortion of the color selection electrode and consequently reduces overall doming effects due to thermal effects.

Experiments have however shown that in this prior art construction, overall doming does still negatively affect the picture quality.

OBJECTS AND SUMMARY OF THE INVENTION

It is therefore an object of the invention to reduce overall doming and thus to improve the picture quality of a color display tube.

To that end, a color display tube of the type defined in the opening paragraph, is characterized in that the border of the color selection electrode is of such a shape that substantially every point of the border of the color selection electrode constitutes an element of an electron beam path.

During usage, this results in the electron beams impinging directly on the entire border, which, as has been found during experiments, reduces overall doming of the color selection electrode.

A preferred embodiment of the color display tube according to the invention, is characterized in that for substantially every point of the border the angle between the plane tangent to the border in said point and the electron beam path of which said point is an element, exceeds 5 degrees.

If for a portion of the border said angle is less than 5°, a significant portion of the electrons impinging on said portion is not absorbed but reflected, and said portion is irradiated in a less efficient manner.

A preferred embodiment of the color display tube according to the invention, is characterized in that the average mass per unit of surface of the color selection electrode over substantially the entire, color selection electrode is substantially uniform.

The color selection electrode has an apertured portion and an unapertured border. In the prior art display tube the average mass per unit of surface exceeds the average mass per unit of surface of the apertured portion. Consequently, the apertured portion warm up at a higher rate than the border. An at least substantially uniform average mass per unit of surface further reduces temperature differences in the color selection electrode. The border may, for example, be provided with pits or be thinner than the apertured portion of the color selection electrode. Preferably, the border is provided with pits and is at least as thin as the apertured portion of the color selection electrode. The mechanical strength of the color selection electrode is then substantially uniform, which reduces mechanical strain.

An embodiment of the color display tube according to the invention in which the color selection electrode is coated with a layer having a high electron reflection coefficient, is characterized in that this layer is at least substantially uniformly applied across the color selection electrode inclusive of the border of the color selection electrode.

Such a layer increases the eletron reflection of the color selection electrode, which results in a reduction of the temperature of this color selection electrode as well as a higher degree of uniformity of the temperature over the color selection electrode, inclusive of the border, which reduces overall doming.

A further embodiment of the color display tube according to the invention, in which the display window is provided with a layer having a high thermal absorption coefficient, to absorb the heat given off by the color selection electrode, is characterized in that this layer is applied substantially uniformly over the display window inclusive of the edge of the display window.

Such a layer over the entire display screen, inclusive of the edge, that is to say inclusive of those portions of the display window to which the border of the color selection electrode radiates heat predominantly, reduces temperature differences over the color selection electrode.

A still further embodiment of the color display tube according to the invention is characterized in that the border of the color selection electrode is at least substantially located between the display window and the plane of the color selection electrode, whereby electrons reflected by the collar do not pass through the apertures of the color selection electrode and impinge on the display screen, which detrimentally affects the picture quality.

BRIEF DESCRIPTION OF THE DRAWINGS

Some embodiments of the invention will now be described in greater detail with reference to the accompanying drawings in which.

The Figures are shown schematically, not to scale, corresponding components in the different embodiments usually having been given the same reference numerals.

DESCRIPTION OF THE PREFERRED EMBODIMENTS

Figure 1:
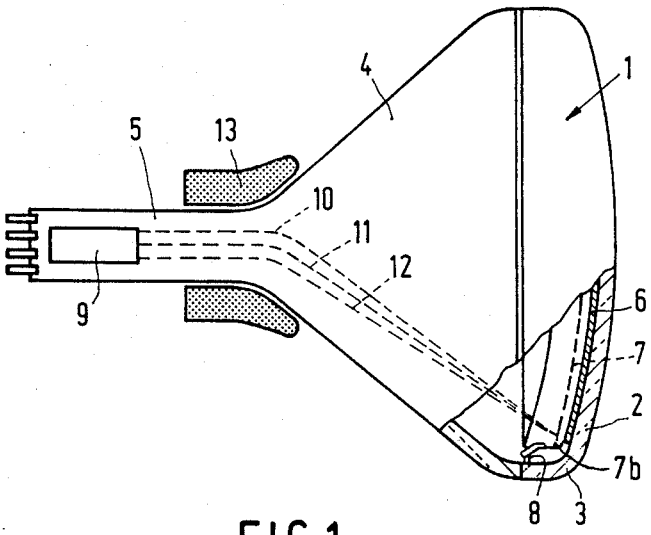
FIG.1 PRIOR ART
FIG. 1 is a schematic, cross-sectional view of a color display tube according to the prior art.

FIG. 1 is a sectional view of a color display tube according to the prior art.

The color display tube includes an envelope 1 which, in this example, comprises a substantially rectangular display window 2 which has an upright edge 3, a cone 4 and a neck 5. A pattern of phosphors 6 luminescing in the colors red, green and blue, is provided on the inside of display window 2.

At a short distance from the display window 2, a substantially rectangular color selection electrode 7 having a large number of apertures and provided with border 7*b*, is suspended with the aid of suspension means 8 near the corners of said upright edge 3.

An electron gun 9 to generate three electron beams 10, 11 and 12 is mounted in the neck 5 of the color display tube. These beams are deflected by means of a system of coils 13 and intersect each other substantially in the region of the color selection electrode 7, whereafter each of the electron beams impings on one of the three phosphors provided on the window.

Each suspension means 8 includes a first element attached to the color selection electrode, this element in this example being a plate-shaped spring element and being arranged transversely of the electron beams 10, 11 and 12 deflected towards the relevant corner, and a second element, this element in this example being provided near the corner of the upright edge 3 of the display window 2.

Figure 2A:
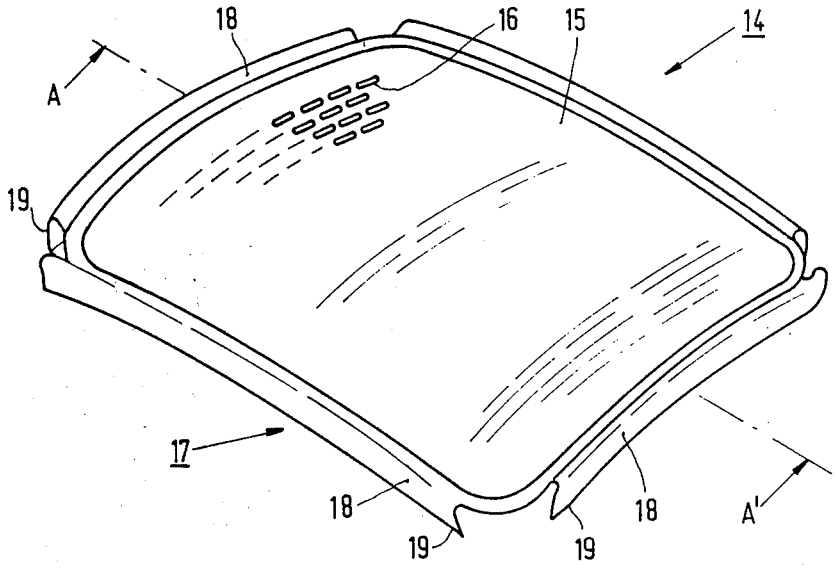
FIG. 2A PRIOR ART
FIG. 2*a* is a perspective shematic drawing of a color selection electrode known from the prior art.

FIG. 2*a* is a perspective view of a color selection electrode 14 of the prior art, constituted by a thin metal plate whose central portion 15 is provided with a large number of apertures 16. The color selection electrode 14 is bulged in accordance with the shape of the display window. The border 17 of the color selection electrode 14 is provided with ridges 18 extending towards the display window and collars 19 extending away from the display window. In this prior art embodiment the collars are folded outwardly and enclose an angle of 25.5 degrees with the longitudinal axis of the tube.

Figure 2B:
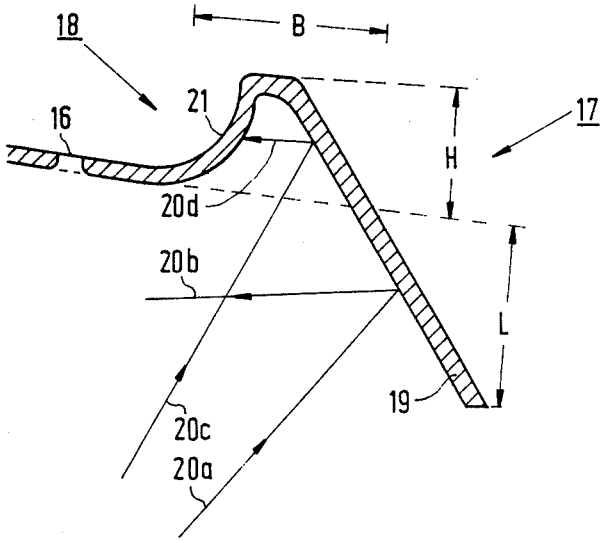
FIG. 2B PRIOR ART
FIG. 2*b* is a sectional view taken on a portion of the line AA' of FIG. 2*a;*

FIG. 2*b* is a cross-sectional view along a portion of the line AA' of FIG. 2*a*. In the example, the ridge 18 has a height H of 5 mm and a width B of 3.5 mm, and the collar 19 has a length L of 8.6 mm. FIG. 2*b* also shows electron beams 20*a* and 20*c* which are deflected by the border 17 of the color selection electrode 14. A portion of the ridge 18, the portion 21, is not directly irradiated by the electron beam 20, but is irradiated indirectly by reflected electrons. In FIG. 2*b*, electron beam 20*d*, obtained by reflection from electron beam 20*c*, irradiates this portion. However, it has been found that in spite of this indirect radiation, significant thermal distortions nevertheless occur.

Figure 3A:
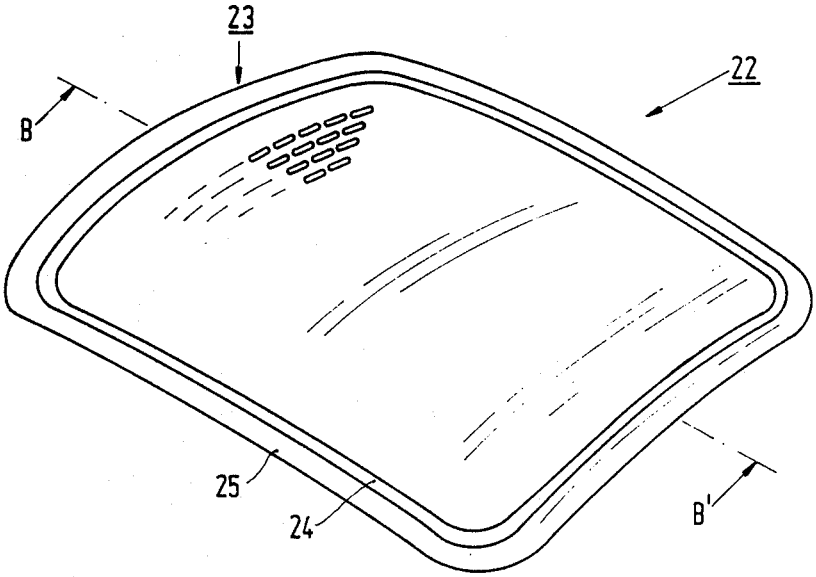
FIG. 3A PRIOR ART
FIG. 3*a* is a perspective schematic view of a color selection electrode suitable for a color display tube of the invention.

FIG. 3*a* is a perspective view of a color selection electrode suitable for a color display tube of the invention. The color selection electrode 22 has a border 23 which includes an interior portion 24 extending towards the display window, and a collar 25, extending away from the window.

Figure 3B:
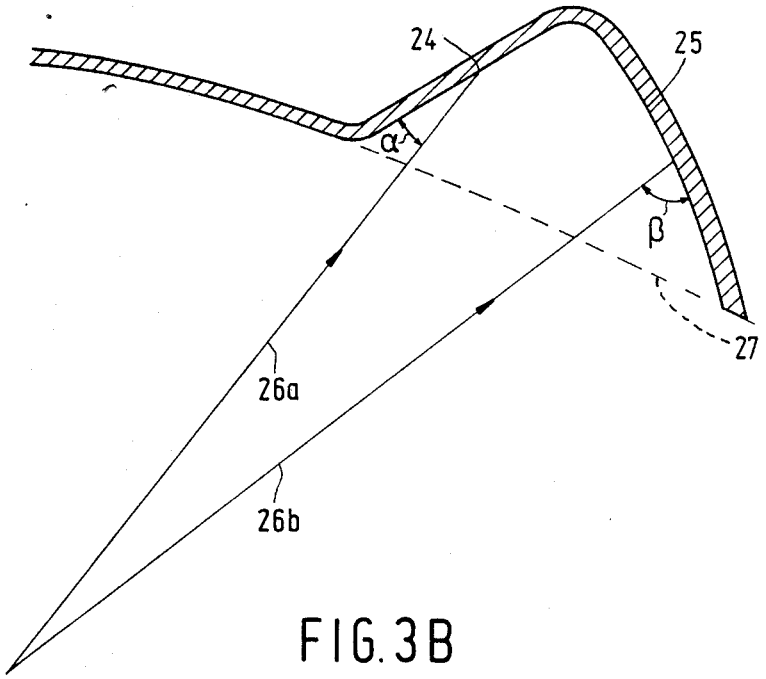
FIG. 3*b* is a sectional view taken on a portion of the line BB' of FIG. 3*a;*

FIG. 3*b* is a cross-sectional view taken on a portion of the line BB' of FIG. 3*b*. The portions 24 and 25 are of such a shape that they are directly irradiated by the electron beams 26*a* and 26*b* which are deflected to the border 23. This causes a uniform supply of heat by the electron beam(s) to the border, which reduces the thermal distortion of the color selection electrode. The angle $\alpha$ between the interior portion 24 and the electron beam 26*a* deflected towards this interior portion, and the angle B between the exterior portion or collar 25 and the electron beam 26*b* deflected towards this exterior portion are both much greater than 5° in this example. All portions of the border are than directly irradiated, with an appropriate efficiency.

In this example, both of the portions 24 and 25 are above the plane of the color selection electron, which plane is indicated in the Figure by broken line 27 so that electrons, directly reflected by the collar 25 cannot pass through apertures to impinge on the display window.

Figure 4:
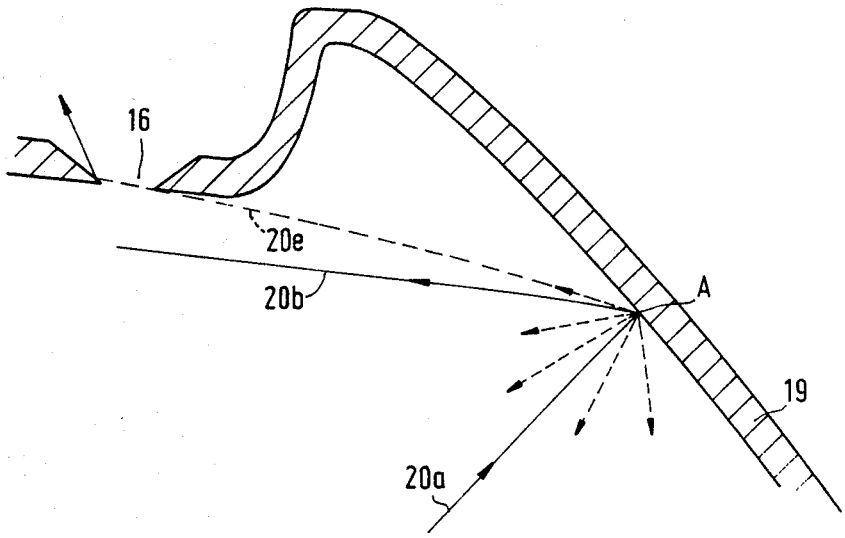
FIG. 4 is an enlargement of the sectional view of FIG. 2*a;*

It has however been found that for a construction of a prior art color selection electrode of the type shown in FIG. 2, a portion of the reflected electrons still pass through the apertures in the color selection electrode. The most probable explanation for this phenomenon is that a portion of the electrons are not directly reflected by the color selection eletrode, but, after having impinged on the color selection electrode, remain absorbed for a certain period of time at the surface of the color selection electrode and the re-emission occurs. For such a process it does not hold for all the electrons that the angle of incidence of the electrons is equal to the angle of re-emission, but each point of the surface acts as a punctilinear source. FIG. 4, an enlarged version of FIG. 2*b*, shows the result of this effect. Electron beam 20*a* impinges on the collar 19 at point A; the directly reflected electron beam 20*b* skims along the color selection electrode and does not pass into the apertures 16. However, due to the above-described effect, electron emission occurs also in other directions, these directions denoted in FIG. 4 by means of broken arrows. Electrons emitted in accordance with line 20*e* do indeed enter the apertures 16 and, after having been reflected once again, impinge on the display screen. This results in a haze being produced at the edge of the display screen. In order to prevent electrons from passing through the apertures, the entire border is consequently contained in the invention between the display window and the plane of the color selection electrode.

Figure 5:
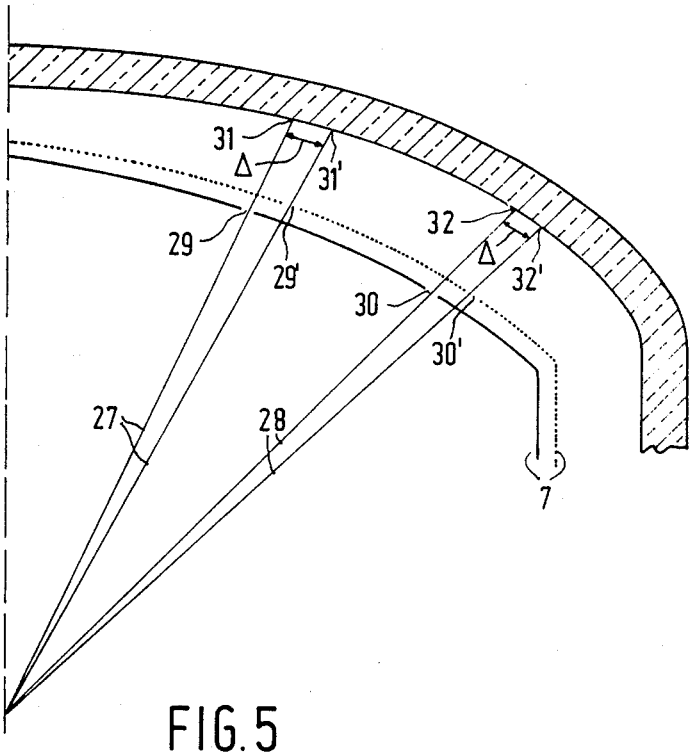
FIG. 5 is a sectional view of a portion of a color display tube, which illustrates the landing displacement on the display screen caused by a uniform heating of the color selection electrode.

Due to warm-up of the color selection caused by irradiation with the electron beams, the color selection eletrode expands. FIG. 5 is a detail of the display tube of FIG. 1 and illustrates the effect of uniform colour selection electrode expansion on landing displacement. In this Figure, color selection electrode 7 is represented in the "cold" state by a solid line, after warm-up by a dotted line. In the "cold" state electron beams 27 and 28 passing through the respective apertures 29 and 30 of the color selection electrode 7 impinge on the screen 2 at the points 31 and 32 respectively. The color selection electrode expands when warmed up, which causes the beams to land at points 29', and 30', respectively. The distance the points 31 and 31' and 32 and 32' is denoted the landing displacement. Generally, the landing displacement due to uniform warm-up of the color selection electrode is approximately linear, that is to say the landing displacement is approximately directly proportional to the distance of a point to the center of the window. The linear expansion of the colors selection electrode can be compensated for by suspending the color selection electrode such that when heated it moves away from the display window in such a manner that the landing displacement is compensated. An example of such a suspension is described in the above-cited U.S. Pat. No. 4,551,651 in which, due to the spring action of the flat spring-loaded elements the color selection electrode moves away from the display window when the temperature increases.

Figure 6:
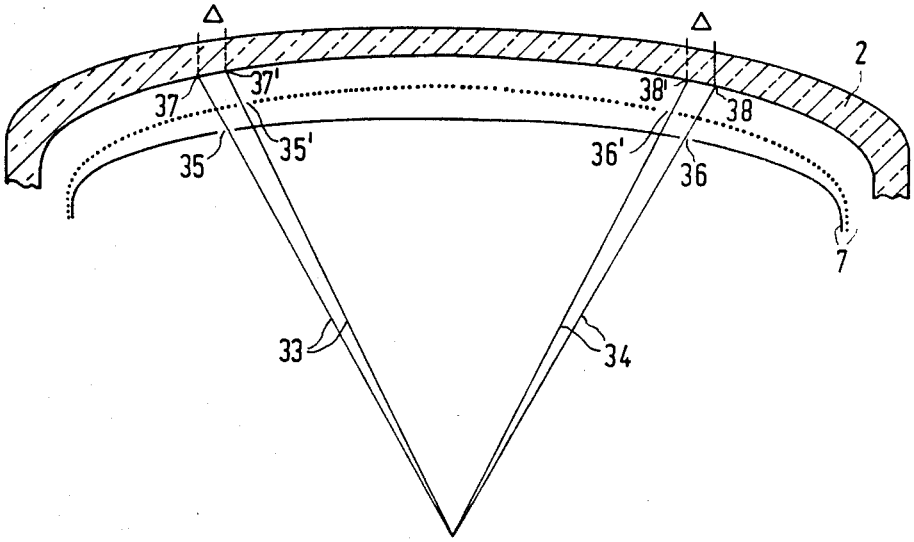
FIG. 6 is a sectional view of a portion of a color display tube, which illustrates the landing displacement on the display screen caused by a non-uniform heating of the color selection electrode.
Figure 7A:
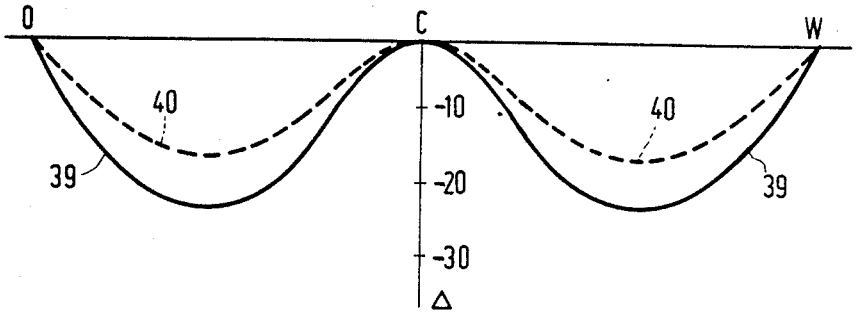
FIG. 7*a* shows in the form of a graph the landing displacement along a line OCW on the display screen.
Figure 7B:
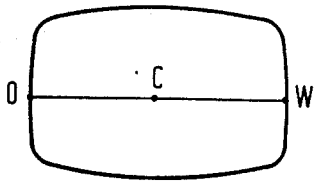
FIG. 7*b* is a plan view of a display window, illustrating the line OCW on the display screen.
Figure 8A:
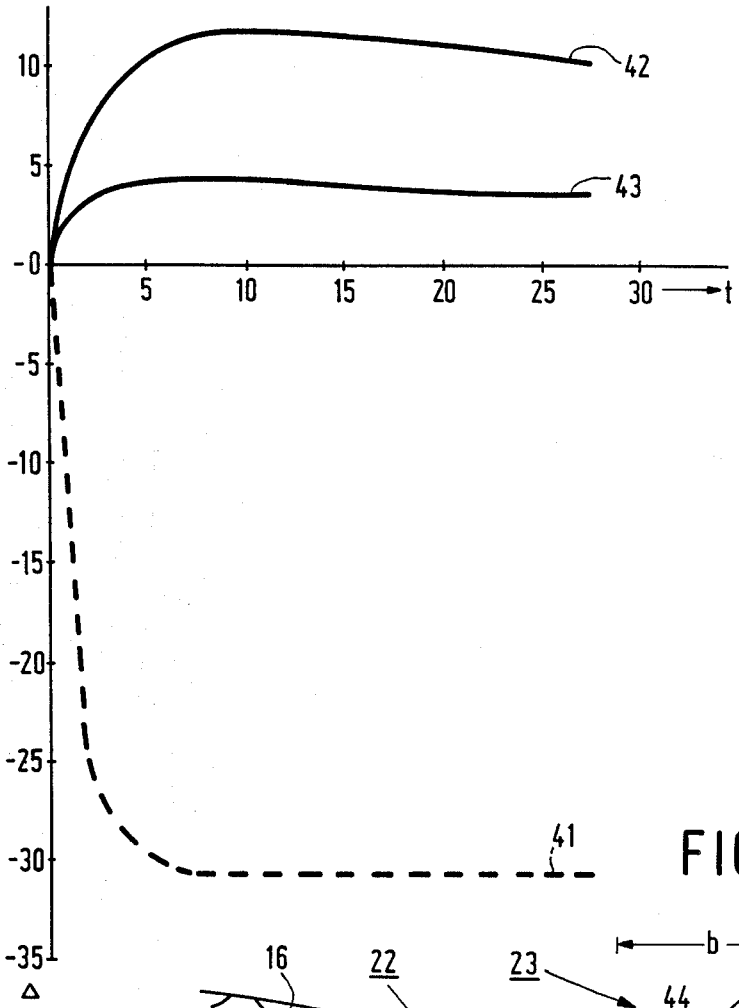
FIG. 8*a* shows in the form of a graph the landing displacement at point B as a function of the time.
Figure 8B:
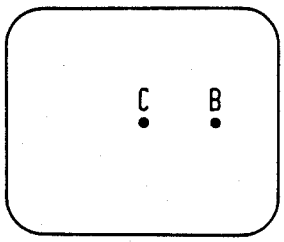
FIG. 8*b* is a view of a display window in which the points C and B are denoted.

Actually, the temperature across the color selection electrode is not uniform, as a result of which an additional bulging or doming of the color selection electrode occurs. FIG. 6 shows the effect of this doming on the landing displacement. In the cold state the electron beams 35 and 36 impinge on the display window 2 at the respective points 37 and 38. Due to the additional bulging of the color selection electrode, the beam landings shift to the respective points 37' and 38'. FIG. 7*a* shows in the form of a graph the variation of such a landing displacement along the line OCW across the display window. The position of the line OCW is shown in FIG. 7*b*. The landing displacement Δ is shown in μm. The landing displacements are negative as they are directed towards the centre of the display window. These landing displacements do not only depend on the position on the window but also on time. In FIG. 7*a* lines 39 and 40 represent the landing displacement at instants t and t' respectively. This landing displacement cannot or can only partly be compensated for by the suspension means. A landing displacement results in the electron beams partially or completely missing the appropriate phosphors, which negatively affects the picture quality. It will thus be ovbious that the landing displacement in FIG. 7*a* as a result of the additional doming of the color selection electrode must be minimized as much as possible. The effect of the invention is illustrated in FIG. 8*a* which shows, in the form of graph, landing displacement Δ as a function of time in one point B on the display window. FIG. 8*b* is a plan view of a display window and shows this point B and the centre C. The curve 41 represents the landing displacement for the prior art tube, curve 42 represents the landing displacement for a tube according to the invention in the same point. It will be obvious that a significant reduction in the landing displacement occurs.

A further reduction of landing displacement can be achieved if the color selection inclusive of the border is uniformly provided with a layer having a high eletron reflection coefficient.

Curve 42 in FIG. 8*a* represents the landing displacement of a display tube according to the invention, in which a bismuth oxide layer is not uniformly applied, that is to say it is only applied on that portion of the color selection electrode that is provided with apertures.

Figure 9:
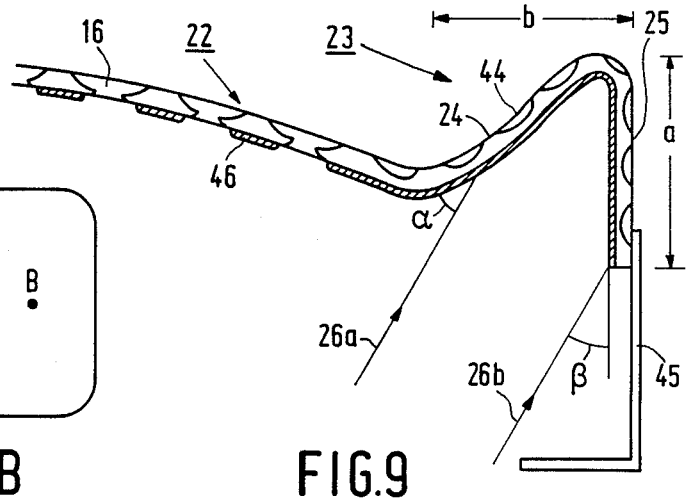
FIG. 9 is a sectional view similar to FIG. 3*b*, showing another embodiment of a color selection electrode suitable for a color display tube according to the invention.

Such a layer provided on the color selection electrode increases electron reflection by color selection electrode, which results in a decrease in the temperature of this color selection electrode. The use of layers of this type is known. They may consist of, for example, bismuth oxide or a lead borate glass. A uniform distribution of this layer across the overall color selection electrode inclusive of the border further reduces temperature differences across the color selection electrode, and, consequently, overall doming. FIG. 9 is a section view of a color selection electrode 22 including apertures 16 and a border 23, having a height a of 0.5 cm and a width b of 0.5 cm. The electrode is attached to a frame 45 and is provided with a layer 46 having a high electron reflection coefficient. Curve 43 in FIG. 8*a* represents the landing displacement for a picture tube according to the invention, in which a bismuth oxide layer is uniformly applied. It will be obvious that this results in a further reduced landing displacement.

In prior art color display tubes the display window is sometimes provided with a layer having a high thermal absorption coefficient.

Such a layer applied on the display window absorbs the heat radiated by the color selection electrode. The layer consists, for example, of a coating containing a mixture of soot and graphite. In the color display tube according to the invention, a uniform distribution of the above-mentioned layer over the entire display window inclusive of the edge, that is to say including those portions of the display window to which the border of the color selection electrode radiates heat predominantly, reduces temperature differences across the color slection electrode and thus further reduces doming.

In a further embodiment of a color display tube according to the invention, the color selection electrode 22 (FIG. 9) includes pits 44 in border 23. The volume of the pits 44 per unit of surface is approximately equal to the volume of the apertures 16 per unit of surface, and the thickness of the color selected electrode is uniform, so that the average mass per unit of surface across the entire color selection electrode 22 is at least substantially uniform. The supply heat being approximately equal per unit of surface, the border and the apertured portion warm-up approximately equally fast, so that temperature differences across the color selection electrode decrease.

It will be obvious that many variations within the scope of the invention are possible for a person skilled in the art.

What is claimed is:

1. A color display tube comprising an envelope having a display window, an electron gun for generating electron beams, a deflection system for deflecting electron beams along electron beam paths, a color selection electrode having a large plurality of apertures, the color selection electrode having a border including an interior portion extending away from the display window, and suspension means for suspending the color selection electrode in the envelope, characterized in that substantially every point of the border of the colour selection electrode constitutes an element of an electron beam path.

2. A color display tube as claimed in claim 1, in which for substantially every point of the border of the color selection electrode, the angle between the plane tangent to the border at said point and the electron beam path of which said point is an element exceeds 5°.

3. A color display tube as claimed in claim 1, in which the average mass per unit of surface of the color selection electrode across the entire color selection electrode is substantially uniform.

4. A color display tube as claimed in claim 3, in which the border is provided with pits.

5. A color display tube as claimed in claim 3, in which the border is thinner than the apertured protion of the color selection electrode.

6. A color display tube as claimed in claim 1, in which the color selection electrode inclusive of the border is uniformly provided with a layer having a high electron reflection coefficient.

7. A color display tube as claimed in claim 1, in which the display window inclusive of the edge of the display window is provided substantially uniformly with a layer having a high thermal absorption coefficient.

8. A color display tube as claimed in claim 1, in which the border is located substantially entirely between the display window and the plane of the color selection electrode.

* * * * *